US007086364B2

(12) United States Patent
Udono

(10) Patent No.: US 7,086,364 B2
(45) Date of Patent: Aug. 8, 2006

(54) INTAKE SYSTEM FOR V-ENGINE

(75) Inventor: Takashi Udono, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/060,778

(22) Filed: Feb. 18, 2005

(65) Prior Publication Data

US 2005/0188959 A1 Sep. 1, 2005

(30) Foreign Application Priority Data

Mar. 1, 2004 (JP) ..... 2004-056715

(51) Int. Cl.
*F02M 35/10* (2006.01)

(52) U.S. Cl. ..... 123/184.21

(58) Field of Classification Search ..... 123/184.21, 123/470, 472, 184.31, 184.34
See application file for complete search history.

(56) References Cited

U.S. PATENT DOCUMENTS

2005/0066926 A1* 3/2005 Ishikawa et al. ..... 123/184.34

FOREIGN PATENT DOCUMENTS

| | | | |
|---|---|---|---|
| EP | 1 293 653 | A1 | 3/2003 |
| EP | 1 387 081 | A2 | 2/2004 |
| EP | 1 520 978 | A2 | 4/2005 |
| JP | 07-332208 | | 12/1995 |
| JP | 2002-202034 | A | 7/2002 |
| JP | 2002-276317 | A | 9/2002 |

* cited by examiner

*Primary Examiner*—Henry C. Yuen
*Assistant Examiner*—Katrina Harris
(74) *Attorney, Agent, or Firm*—Birch, Stewart, Kolasch & Birch, LLP

(57) ABSTRACT

The intake system includes an intake path forming section having a downstream end in communication with an intake port included in each of cylinder heads of a pair of banks of an engine main body. The intake path connects to the common air chamber with an upstream end of the intake path being open in the air chamber. A fuel injection valve for injecting fuel toward the upstream end opening portion of each intake path is disposed in the air chamber. A path forming member constituting at least part of an intake path forming section by forming an upstream end of an intake path is connected to a first wall portion of an air chamber. A fuel injection valve is mounted from the outside in a second wall portion of the air chamber opposing the first wall portion with a leading end portion facing an inside of the air chamber.

20 Claims, 8 Drawing Sheets

INTAKE SYSTEM FOR V-ENGINE

CROSS-REFERENCE TO RELATED APPLICATIONS

The present non-provisional application claims priority under 35 USC 119 to Japanese Patent Application No. 2004-056715 filed on Mar. 1, 2004 the entire contents thereof is hereby incorporated by reference.

BACKGROUND OF THE INVENTION

1. Field of the Invention

The present invention relates generally to an intake system for a V-engine. More particularly, the present invention relates to an intake system for a V-engine having the following specific arrangements. A main body of the V-engine is formed as follows. First and second banks are formed into the letter V. An intake path forming section forms an intake path having a downstream end in communication with each intake port disposed in each of cylinder heads of the two banks. The intake path forming section is connected to an air chamber such that an upstream end of the intake path opens into the air chamber commonly provided for the two cylinder heads. A plurality of fuel injection valves for injecting fuel toward the upstream end opening portion of each of the intake paths in the air chamber is disposed in the air chamber.

2. Description of Background Art

Such an intake system for a V-engine is well-known as disclosed, for example, in Japanese Patent Laid-open No. 2002-202034.

The intake system disclosed in Japanese Patent Laid-open No. 2002-202034 is constructed as follows. The V-engine includes a plurality of fuel injection valves injecting fuel toward an upstream end opening portion in an air chamber of each of intake paths. Each of the intake paths individually connects to a corresponding one of cylinder heads of a pair of front and rear banks. An entire structure of the plurality of fuel injection valves is accommodated in the air chamber. The fuel injection valves thus occupy a relatively large volume in a space of the air chamber. This not only reduces a substantial volume of the air chamber, but also imposes restrictions on the shape of the air chamber.

SUMMARY AND OBJECTS OF THE INVENTION

It is therefore an object of the present invention to provide an intake system for a V-engine designed for enhancing a degree of freedom in the shape and design of the air chamber, while securing a substantial volume for the air chamber.

To achieve the foregoing object, an intake system for a V-engine according to a first aspect of the present invention has the following specific arrangements. The engine has an engine main body shaped into the letter V by first and second banks. An intake path forming section is provided for forming an intake path. The intake path has a downstream end in communication with an intake port included in each of the cylinder heads included in the first and second banks. The intake path forming section connects to an air chamber common to the cylinder heads such that an upstream end of the intake path opens in the air chamber. A plurality of fuel injection valves is disposed in the air chamber. These fuel injection valves inject fuel toward the upstream end opening portion of the intake path in the air chamber. The intake system includes a path forming member constituting at least part of the intake path forming section by forming the upstream end of the intake path that connects to a first wall portion of the air chamber. Further, each of the fuel injection valves is mounted from an outside on a second wall portion of the air chamber opposing the first wall portion such that a leading end portion thereof faces an inside of the air chamber.

According to a second aspect of the present invention, the intake system includes at least part of the air chamber that is disposed between the first and second banks. Further, upstream ends of the intake paths on a side of the first and second banks are disposed close to each other as viewed from a side with the first and second banks arranged in a fore-aft direction.

According to a third aspect of the present invention, the intake system includes in the side view with the first and second banks arranged in the fore-aft direction, a center axis of each of the plurality of fuel injection valves that is disposed inside a triangle formed with extension lines toward an upstream side of axes of the intake paths on the side of the first and second banks and a straight line connecting centers on the upstream ends of the intake paths on the side of the first and second banks.

According to a fourth aspect of the present invention, the intake system includes rear portions of the plurality of fuel injection valves that are fitted in, and connected to, a delivery pipe disposed on an outside of the air chamber. The fuel injection valves are then mounted in the second wall portion by having coupler portions for connecting electrical wires thereto are disposed on the outside of the air chamber.

According to a fifth aspect of the present invention, the intake system includes each of the plurality of fuel injection valves being disposed in the air chamber as valves intended for a high-speed operation of the engine. A fuel injection valve for injecting fuel at all times during operation of the engine is mounted in the intake path forming section so as to inject fuel directly into the intake path.

According to a sixth aspect of the present invention, the intake system includes an air chamber that serves also as a cleaner case for an air cleaner including a filter element.

According to a seventh aspect of the present invention, the intake system includes an air chamber that is divided into a purified chamber and an unpurified chamber with the filter element as a partition. Part of the intake path forming section is accommodated inside the unpurified chamber.

According to the first aspect of the present invention, a volume of the fuel injection valves taking up a space inside the air chamber can be made small, thereby providing a greater substantial space for the air chamber. The degree of freedom in the shape and design of the air chamber can thus be enhanced.

According to the second aspect of the present invention, in the side view with the first and second banks arranged in the fore-aft direction, the upstream ends of the intake paths on the side of the first and second banks are close to each other inside the air chamber disposed between the two banks. The fuel injection valves disposed in the second wall portion, which opposes the first wall portion to which the intake path forming portion is connected, on the side of the first and second banks can also be disposed close to each other. This enables compact disposition of the fuel injection valves.

According to the third aspect of the present invention, each of the fuel injection valves can be disposed even closer to each other. This enables an even more compact disposition of the fuel injection valves.

According to the fourth aspect of the present invention, fuel piping and electrical wiring connected to each of the fuel injection valves are disposed on the outside of the air chamber. This facilitates the jobs of assembling the fuel injection valves in the air chamber and of servicing and inspecting, thus leading to an enhanced workability. Moreover, placement of the fuel piping and the electrical wiring requires no penetration through the wall portion of the air chamber. This eliminates the need for extra parts and the like for achieving a good sealing performance.

According to the fifth aspect of the present invention, fuel is directly injected into the intake paths at all times during the operation of the engine from the fuel injection valves disposed closer to the cylinder heads. This enhances the response in fuel supply control.

According to the sixth aspect of the present invention, the air chamber serves also as the cleaner case. This not only eliminates the need for securing a space for disposing the cleaner case in addition to the air chamber, but also reduces the number of parts required.

According to the sixth aspect of the present invention, part of the intake path forming portions is accommodated in the unpurified chamber of the air chamber. An even greater volume can be provided for the air chamber as compared with a type in which the upstream end of the intake path forming portion is connected to the wall portion of the air chamber.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A preferred embodiment of the present invention will be described with reference to the exemplary case shown in the accompanying drawings.

Figure 1:
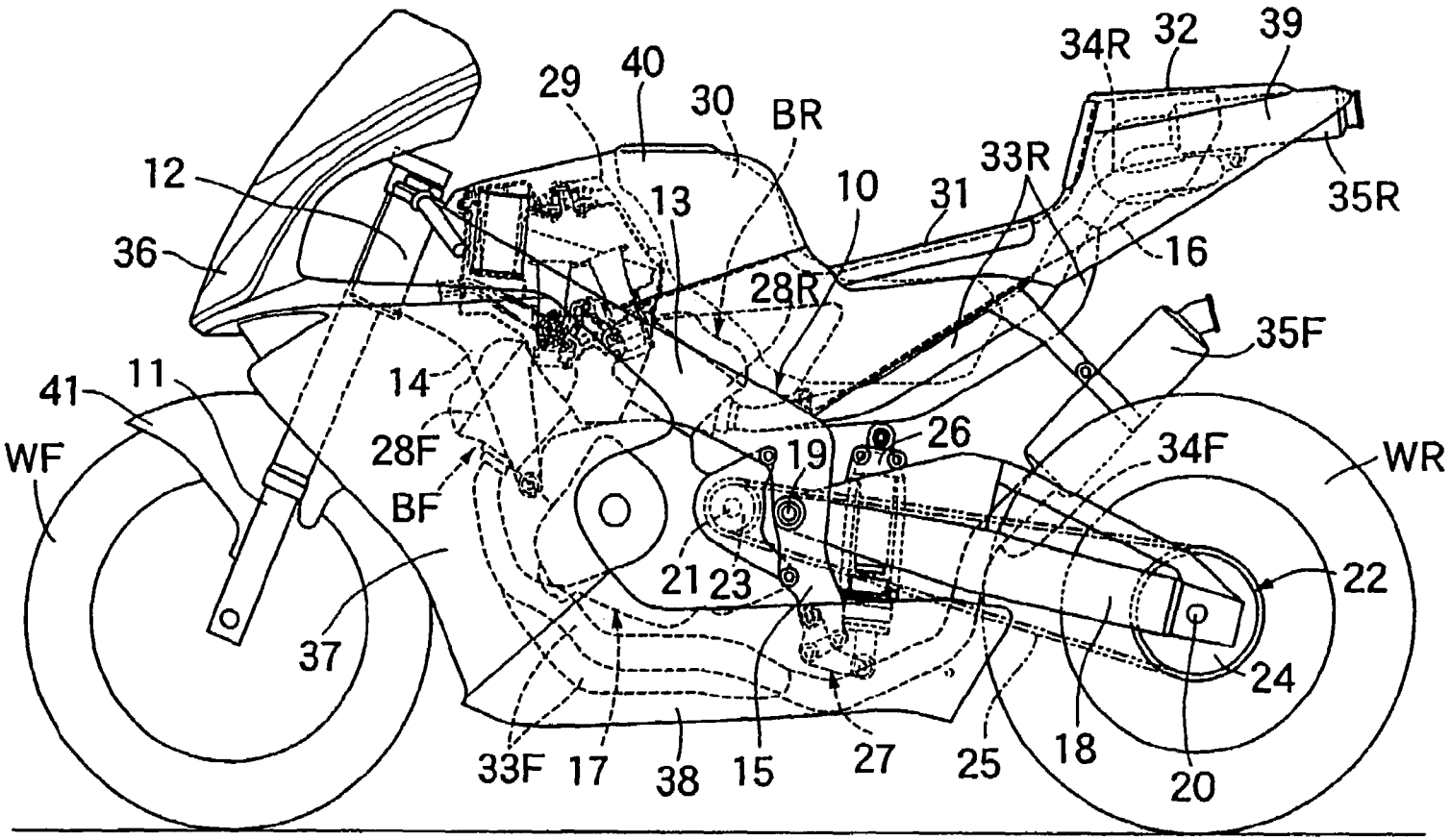
FIG. 1 is a side elevational view showing a motorcycle.

FIGS. 1 through 7 show a preferred embodiment of the present invention. Referring first to FIG. 1, a vehicle body frame F of the motorcycle includes a head pipe 12, a pair of right and left main frames 13, a pair of right and left engine hangers 14, a pair of right and left pivot plates 15, and a rear portion frame 16. The head pipe 12 steerably supports a front fork 11 journaling a front wheel WF. Each of the right and left main frames 13 . . . extends rearwardly and downwardly from the head pipe 12. Each of the right and left engine hangers 14 . . . is welded to a front portion of the head pipe 12 and the main frames 13 . . . and extends downwardly from the main frames 13 . . . Each of the right and left pivot plates 15 . . . extends downwardly from a rear portion of each of the main frames 13 . . . The rear portion frame 16 extends rearwardly and upwardly and is connected to the rear portion of each of the main frames 13 . . . .

An engine main body 17 includes a front portion bank BF as a first bank and a rear portion bank BR as a second bank and that may, for example, be configured into a V-five type. The main body 17 is supported at a lower portion of the engine hangers 14 . . . , an intermediate portion of the main frames 13 . . . , and an upper portion and a lower portion of the pivot plates 15 . . . .

A front end portion of a swing arm 18 is swingably supported on an intermediate portion in a vertical direction of the pivot plates 15 . . . by way of a pivot shaft 19. An axle 20 of a rear wheel WR is rotatably supported on a rear end portion of the swing arm 18.

A transmission is built into the engine main body 17. A power drive from an output shaft 21 of the transmission is transmitted to the rear wheel WR via chain transmission means 22. The chain transmission means 22 includes a drive sprocket 23, a driven sprocket 24, and an endless chain 25. The drive sprocket 23 is secured to the output shaft 21. The driven sprocket 24 is secured to the rear wheel WR. The endless chain 25 is wound around the drive sprocket 23 and the driven sprocket 24.

An upper end portion of a rear shock absorber 26 is connected to a front portion of the swing arm 18. A lower end portion of the rear shock absorber 26 is connected to a lower portion of each of the right and left pivot plates 15 via a linkage mechanism 27.

An air chamber 29 is disposed above cylinder heads 28F, 28R in the front portion bank BF and the rear portion bank BR of the engine main body 17. A fuel tank 30 is supported on the rear portion frame 16. The fuel tank 30 covers the engine main body 17 from above in rear of the air chamber 29. A main seat 31 is supported on the rear portion frame 16 rearward of the fuel tank 30. A rider sits astride the motorcycle on the main seat 31. There is a pillion seat 32 for allowing a passenger to ride thereof. The pillion seat 32 is supported on the rear portion frame 16 at a position away from and rearward of the main seat 31.

First individual exhaust pipes 33F . . . continue into corresponding ones of cylinders of the cylinder head 28F of the front portion bank BF. The first individual exhaust pipes 33F . . . are disposed extendedly downward of the engine main body 17 toward a side of the rear wheel WR. Each of the first individual exhaust pipes 33F . . . is connected commonly to a first converging exhaust pipe 34F. A first exhaust muffler 35F disposed on the right-hand side above the rear wheel WR is supported on the rear portion frame 16. A downstream end of the first converging exhaust pipe 34F is connected to the first exhaust muffler 35F. Second individual exhaust pipes 33R . . . continue into corresponding ones of cylinders of the cylinder head 28R of the rear portion bank BR. The second individual exhaust pipes 33R . . . extend rearwardly along a portion above the rear shock absorber 26. Each of the second individual exhaust pipes 33R . . . is connected commonly to a second converging exhaust pipe 34R. A second exhaust muffler 35R is disposed below the pillion seat 32. The second exhaust muffler 35R is supported on the rear portion frame 16. A downstream end of the second converging exhaust pipe 34R is connected to the second exhaust muffler 35R.

A space forward of the head pipe 12 is covered with a front cowl 36 formed from a synthetic resin. Both sides at a front portion of the vehicle body are covered with a center cowl 37 formed from a synthetic resin and continuing from the front cowl 36. Lower cowls 38 . . . formed from a synthetic resin are provided in a connected row arrangement for the center cowl 37. The lower cowls 38 . . . cover both sides of part of the engine main body 17 and the first individual exhaust pipes 33F . . . continuing to the cylinder head 28F of the front portion bank BF. In addition, a rear cowl 39 covers a rear portion of the rear portion frame 16 together with the most part of the second exhaust muffler 35R. A cover 40 covers the fuel tank 30 and the air chamber 29. A front fender 41 covering a space above the front wheel WF is attached to the front fork 11.

Figure 2:
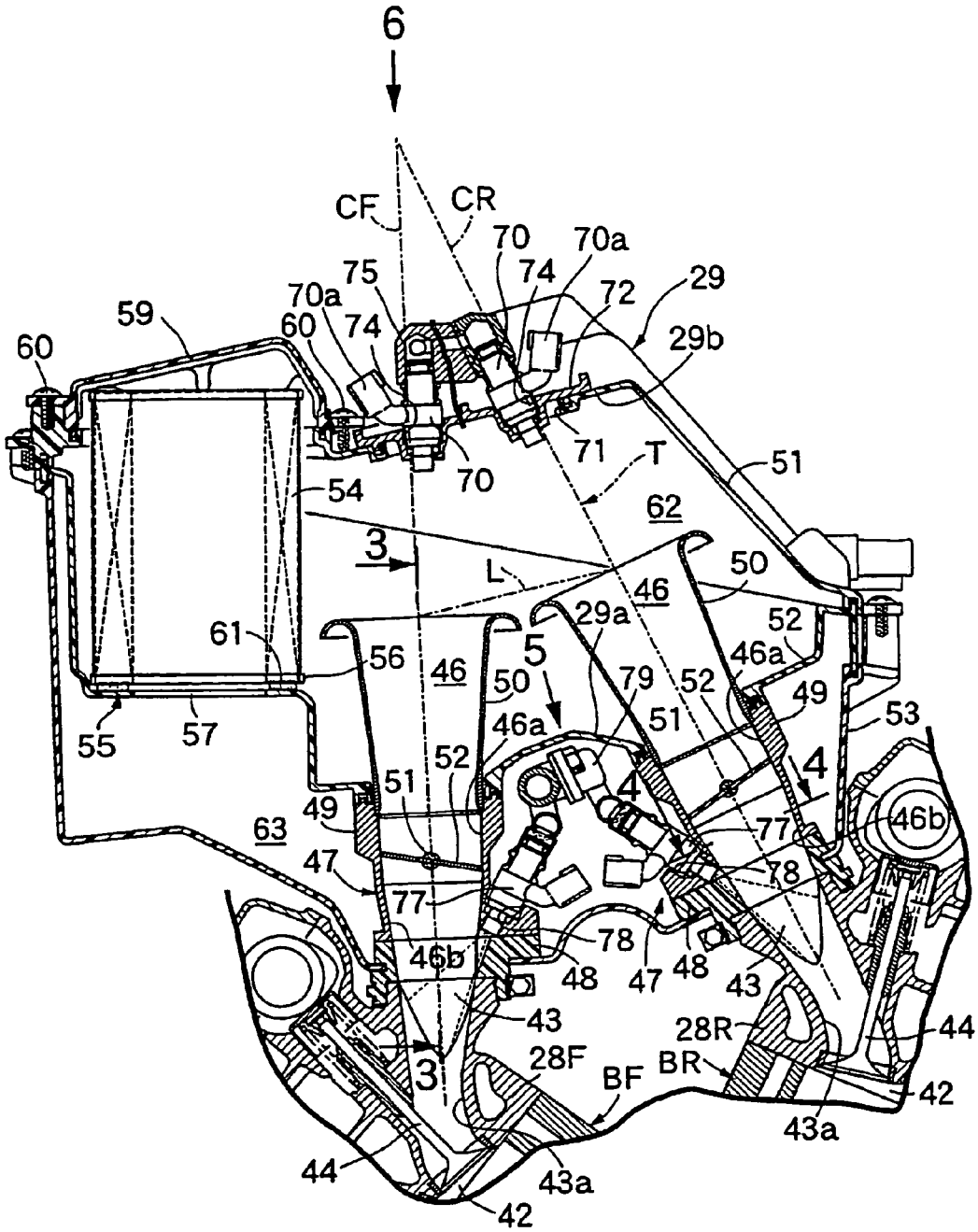
FIG. 2 is an enlarged longitudinal cross sectional view showing an area near an air chamber, taken along line 2—2 of FIG. 6.
Figure 3:
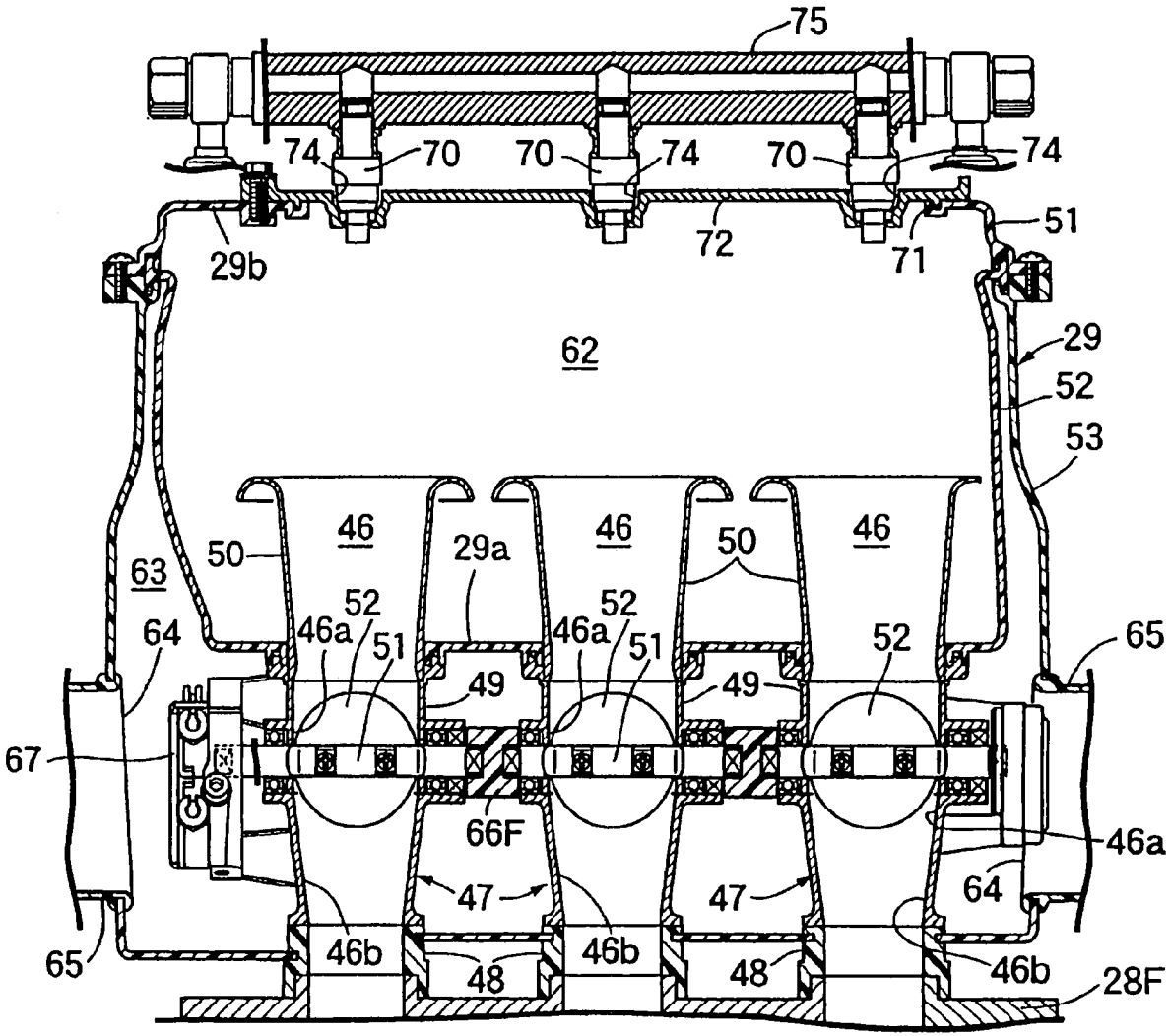
FIG. 3 is a cross sectional view taken along line 3—3 of FIG. 2.

Referring to FIGS. 2 and 3, the front portion bank BF of the engine main body 17 includes three cylinders, while the rear portion bank BR of the engine main body 17 includes two cylinders. The cylinder heads 28F, 28R in the front portion bank BF and the rear portion bank BR include intake ports 43 . . . having a bifurcated pair of branch path portions 43*a* . . . so as to communicate with each of combustion chambers 42 . . . of the cylinders. A pair of intake valves 44 . . . are disposed in the cylinder heads 28F, 28R for each cylinder so as to open and close the branch path portions 43*a*. . . Upstream ends of the intake ports 43 . . . are open to upper portion side walls of the cylinder heads 28F, 28R.

There is disposed between the front portion bank BF and the rear portion bank BR at least part of the air chamber 29 common to the cylinder heads 28F, 28R of the two banks BF, BR. According to the preferred embodiment of the present invention, most of the air chamber 29 is disposed between the front portion bank BF and the rear portion bank BR above the cylinder heads 28F, 28R.

A downstream end of each of intake paths 46 . . . , individually provided for corresponding ones of the cylinders, is in communication with the intake ports 43 . . . of the cylinder beads 28F, 28R in the two banks BF, BR. Intake path forming portions 47 . . . , forming the intake paths 46, . . . are connected to the air chamber 29 such that upstream ends of the intake paths 46 are open to the air chamber 29. Each of the intake path forming portions 47 . . . includes an insulator 48, a throttle body 49, and an air funnel 50. The insulator 48 is connected to the upper portion side wall of the cylinder heads 28F, 28R so as to continue into the intake ports 43 . . . . The throttle body 49 has a downstream end connected to the insulator 48. The air funnel 50 is connected to an upstream end of the throttle body 49.

A valve shaft 51 traversing the intake path 46 is rotatably supported on the throttle body 49. A butterfly type throttle valve 52 for regulating a circulating area of the intake path 46 is secured to the valve shaft 51.

Figure 4:
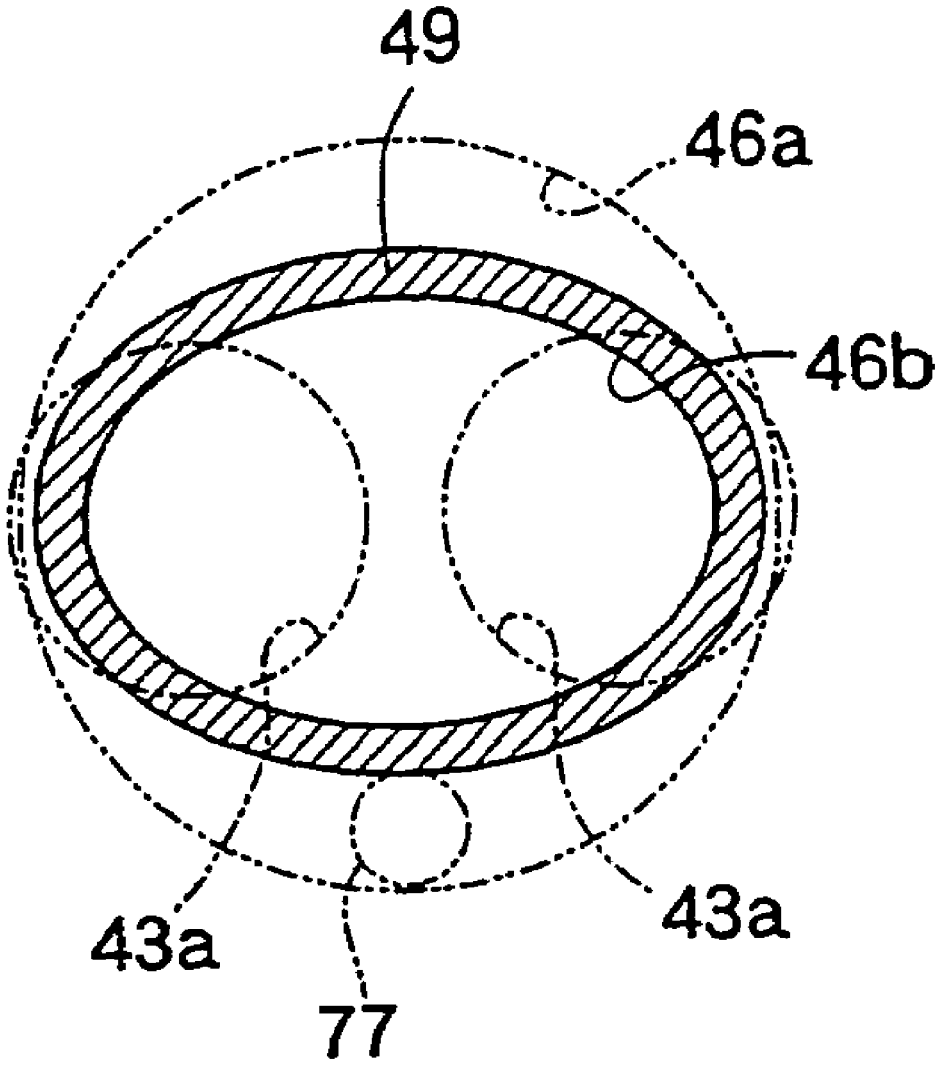
FIG. 4 is a cross sectional view taken along line 4—4 of FIG. 2.

The shape of a transverse cross section of a path portion 46*a*, at which the throttle valve 52 is disposed, in the intake path 46 of the throttle body 49 is circular. In addition, the shape of a transverse cross section of a path portion 46*b* at the downstream end is an ellipse having a direction of arrangement of the branch path portions 43*a*, 43*a* of the intake ports 43 in the cylinder heads 28F, 28R as the major axis direction as shown in FIG. 4.

The shape of a transverse cross section of the insulator 48 and that of an upstream end of the intake port 43 are also formed into an ellipse corresponding to the shape of the transverse cross section of the path portion 46*b* at the downstream end in the throttle body 49. Accordingly, the shape of the transverse cross section changes smoothly from a circle to an ellipse for a range of portions covering from the intake path 46 downstream of the throttle valve 52 to the branch path portions 43*a* . . . of the intake port 43. This allows the length from the throttle valve 52 to the branch path portions 43*a* . . . of the intake port 43, that is, the pair of intake valves 44 to be set relatively short.

The major axis of the elliptic path portion 46*b* is set smaller than the diameter of the path portion 46*a*, at which the throttle valve 52 is disposed. This allows a draft direction of a core for forming an inner surface of the throttle body 49 to be set in one direction when casting the throttle body 49. Need for machining the inner surface of the throttle body 49 can thus be eliminated. Thus, a simple two-part mold can be used. All this contributes to a reduced manufacturing cost of the throttle body 49.

The air chamber 29 includes an upper portion, an intermediate portion, and a lower portion case members 51, 52, 53 formed from a synthetic resin. The upper portion, intermediate portion, and lower portion case members 51, 52, 53 are mutually connected together such that the upper portion case member 51 and the lower portion case member 53 sandwich the intermediate portion case member 52. The upper portion case member 51 and the lower portion case member 53 are formed into bowls with their respective opposing sides opened. The intermediate portion case member 52 is formed so as to partition off the air chamber 29 into upper and lower halves.

The air chamber 29 serves also as a cleaner case for an air cleaner 55 including a filter element 54. A communication hole 57 is provided in the intermediate portion case member 52 at a position above the front portion bank BF. An opening portion 58 is provided in the upper portion case member 51 at a position above the communication hole 57. A lid member 59 for closing the opening portion 58 is removably attached to the upper portion case member 51 using a plurality of screw members 60 . . . .

A support frame 56 supporting the filter element 54, formed into a cylindrical shape, is clamped between the intermediate portion case member 52 and the lid member 59 at a portion corresponding to the communication hole 57. An endless sealing member 61 surrounding the communication hole 57 is interposed between the support frame 56 and the intermediate portion case member 52.

Accordingly, the air chamber 29 is divided into a purified chamber 62 and an unpurified chamber 63 with the filter element 54 as a partition. More specifically, the purified chamber 62 is a space formed between the upper portion case member 51 and the intermediate case member 52, excluding the filter element 54. The unpurified chamber 63 includes a space between the intermediate portion case member 52 and the lower portion case member 53 and an inside of the filter element 54. The filter element 54 therefore filters air circulating from the unpurified chamber 63 to the purified chamber 64 by way of the filter element 54.

Air introduction holes 64, 64 for communicating with the unpurified chamber 63 are provided on both sides of the lower portion case member 53. Intake ducts 65, 65 for drawing in outside air into the unpurified chamber 63 through the air introduction holes 64, 64 are connected to both sides of the lower portion case member 53.

The lower portion case member 53 is supported by the intake path forming portions 47 . . . of the cylinders in the engine main body 17. Cylinder bores are joined to the cylinder heads 28F, 28R with the ring-shaped insulators 48 interposed between the throttle bodies 49 of the intake path forming portions 47 . . . and the cylinder heads 28F, 28R, clamped between the cylinder heads 28F, 28R. This results in the lower portion case member 53 being supported by the insulators 48 . . . , that is, a plurality of the intake path forming portions 47 . . . The throttle bodies 49 forming part of the intake path forming portions 47, . . . are accommodated in the unpurified chamber 63 so as to be clamped between the intermediate portion case member 52 and the insulators 48 . . . Each of the air funnels 50 . . . connected to each of the throttle bodies 49 . . . projects into the purified chamber 62 from the intermediate portion case member 52.

Figure 5:
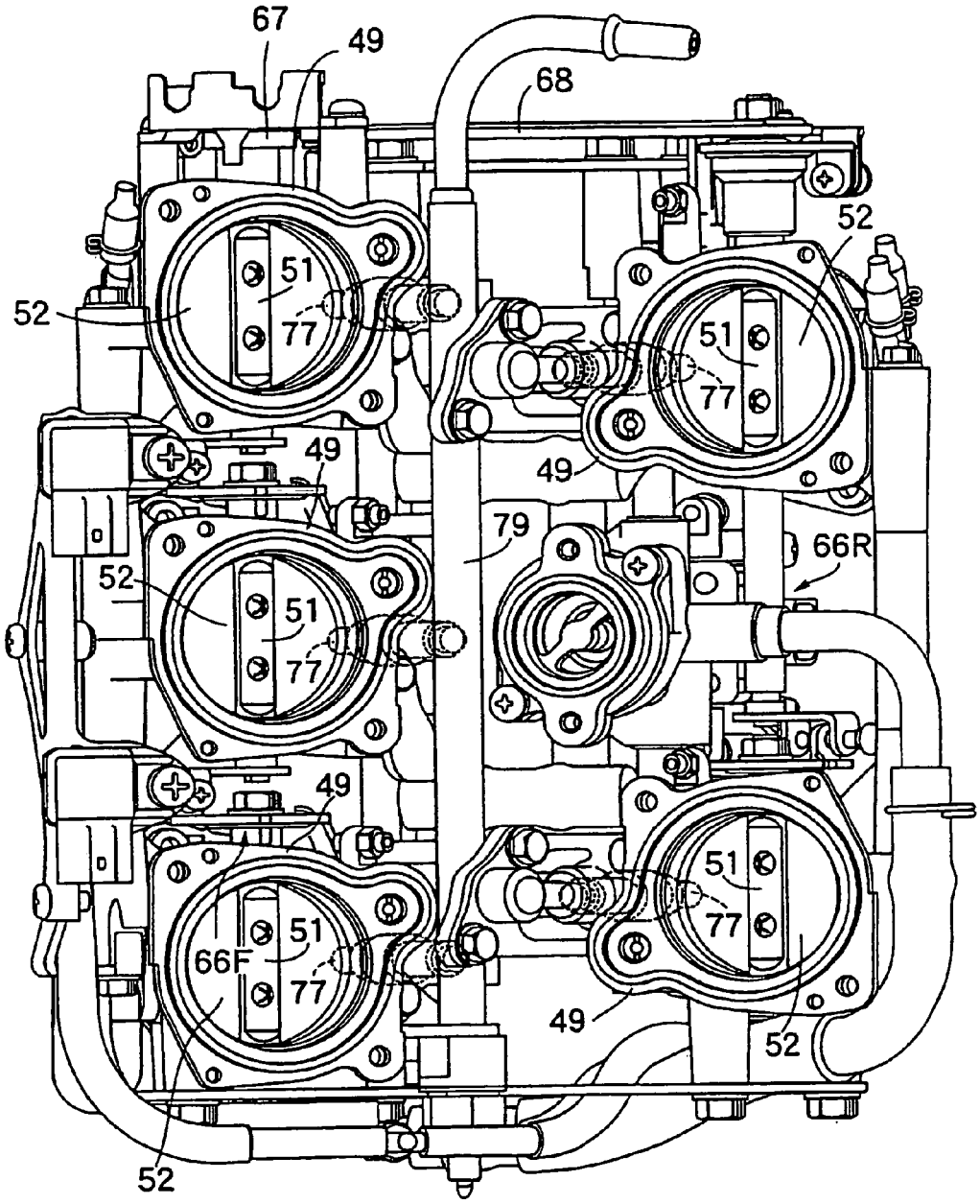
FIG. 5 is a view on arrow 5 of FIG. 2 with the air chamber removed.

Referring to FIG. 5, at the front portion bank BF, there are three throttle valves 52 . . . of the throttle bodies 49 . . . corresponding to the front portion bank BF fastened to the valve shafts 51 . . . Referring to the rear portion bank BR, there are two throttle valves 52 . . . of the throttle bodies 49 . . . corresponding to the rear portion bank BR fastened to the valve shafts 51 . . . . The valve shafts 51 . . . are mutually operatively connected through connecting means 66F, 66R. A throttle drum 67 is disposed on an outer side surface of the throttle body 49 on one end along the arrangement direction of the throttle bodies 49 . . . on the front portion bank BF. The throttle drum 67 continues into the valve shafts 51 . . . that are mutually operatively associated and connected together. A throttle operating force is transmitted from the throttle drum 67 to the operatively associating and connecting means 66R on the side of the rear portion bank BR via an operatively associating lever 68.

Air funnels 50 . . . form downstream ends of the intake paths 46 . . . so as to serve as path forming members constituting at least part of the intake path forming portions 47 . . . . Lower portions of the air funnels 50 . . . are joined to the throttle bodies 49 . . . as follows. More specifically, while lower end portions of the air funnels 50 . . . are inserted into upper end portions of the throttle bodies 49 . . . , a first wall portion 29*a* forming part of the intermediate portion case member 52 forming part of the air chamber 29 is clamped by the throttle bodies 49 . . . . That is, the air funnels 50 . . . are connected to the first wall portion 29*a* of the air chamber 29.

Figure 6:
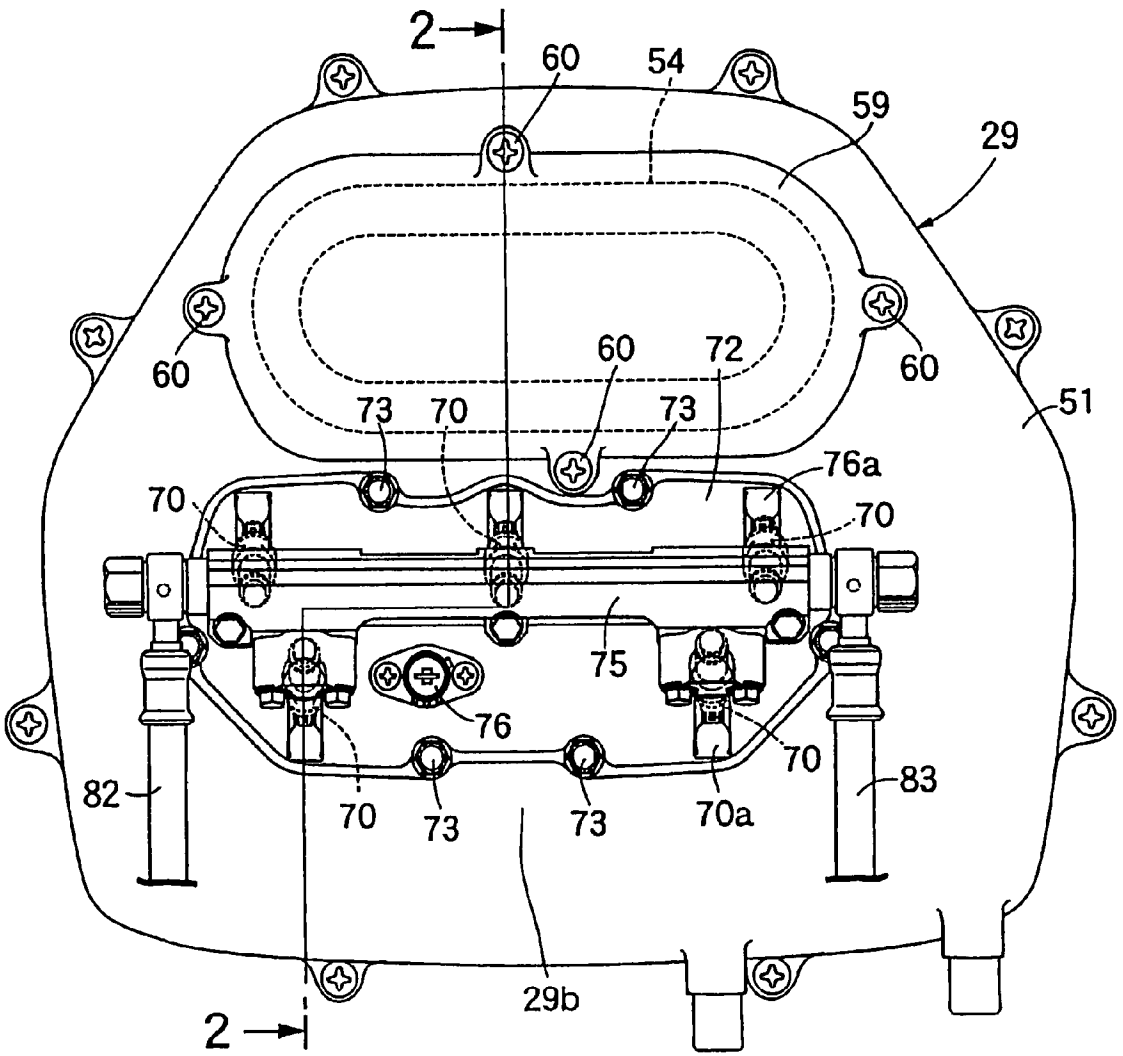
FIG. 6 is a view on arrow 6 of FIG. 2.

Referring to FIG. 6, of the upper portion case member 51 forming part of the air chamber 29, a second wall portion 29*b* opposing the first wall portion 29*a* forms an upper wall portion of the upper portion case member 51. A first fuel injection valve 70 is mounted for each cylinder on this upper wall portion of the upper portion case member 51 from an outside such that a leading end portion thereof faces the inside of the air chamber 29. The first fuel injection valves 70 . . . are designed to inject fuel toward upper end opening portions inside the air chamber 29 of the intake paths 46 . . . when the engine is run at a high speed.

The second wall portion 29*b* of the air chamber 29 includes an opening portion 71 corresponding to each of the air funnels 50 . . . . A support plate 72 for plugging the opening portion 71 from an outside is fastened to the second wall portion 29*b* using a plurality of bolts 73 . . . . There are provided fitting recessed portions 74 . . . in the support plate 72. The leading end portions of the first fuel injection valves 70 . . . have coupler portions 70*a* . . . , to which electrical wires are connected, disposed on the outside of the air chamber 29. The leading end portions of the first fuel injection valves 70 . . . are fitted into the fitting recessed portions 74 . . . from the outside. Rear portions of the first fuel injection valves 70 . . . are commonly fitted in, and connected to, a first delivery pipe 75 disposed on the outside of the air chamber 29. The first delivery pipe 75 is thus fastened to the support plate 72. An intake air temperature sensor 76 is mounted to the support plate 72.

More specifically, the first fuel injection valves 70 . . . are clamped between the support plate 72 and the first delivery pipe 75 fastened to the support plate 72. When the support plate 72 is fastened to the second wall portion 29*b* of the air chamber 29, the first fuel injection valves 70 . . . are mounted to the second wall portion 29*b* from the outside such that the leading end portions of the first fuel injection valves 70 . . . face the inside of the purified chamber 62 of the air chamber 29.

Reference is made to FIG. 2 of a side view showing a layout of the front portion bank BF and the rear portion bank BR in the fore-aft direction. The upstream ends of the intake paths 46 on the side of the front and rear portion banks BF, BR are disposed close to each other in the purified chamber 62 of the air chamber 29. A center axis of the first fuel injection valves 70 . . . is disposed inside a triangle T formed with extension lines toward the upstream side of axes CF, CR of the intake paths 46 on the side of the front and rear portion banks BF, BR and a straight line L connecting centers on the upstream ends of the intake paths 46 on the side of the front and rear portion banks BF, BR.

The first fuel injection valves 70 . . . are disposed in the air chamber 29 for high-speed rotation of the engine. In addition to the first fuel injection valves 70 . . . , second fuel injection valves 77 . . . for injecting fuel at all times during the operation of the engine are mounted in the intake path forming portions 47 . . . so as to directly inject fuel in the intake paths 46 . . . . According to the preferred embodiment of the present invention, the second fuel injection valves 77 . . . are mounted on the throttle bodies 49 . . . of the intake path forming portions 47 . . . .

Of the intake paths 46 of the throttle body 49, the path portions 46*b* . . . at the downstream ends are formed into an ellipse in a transverse cross section thereof. Fitting recessed portions 78 . . . are disposed in the throttle bodies 49 . . . downstream from the throttle valves 52 . . . . The fitting recessed portion 78 has an axis running along a plane including a minor axis of the intake path 46 located downstream from the throttle valve 52. Leading end portions of the second fuel injection valves 77 . . . are fitted into the fitting recessed portions 78 . . . such that fuel is injected from the path portions 46*b* . . . toward the side of the intake ports 43 . . . . Rear portions of the second fuel injection valves 77 . . . are commonly fitted in, and connected to, a second delivery pipe 79.

Figure 7:
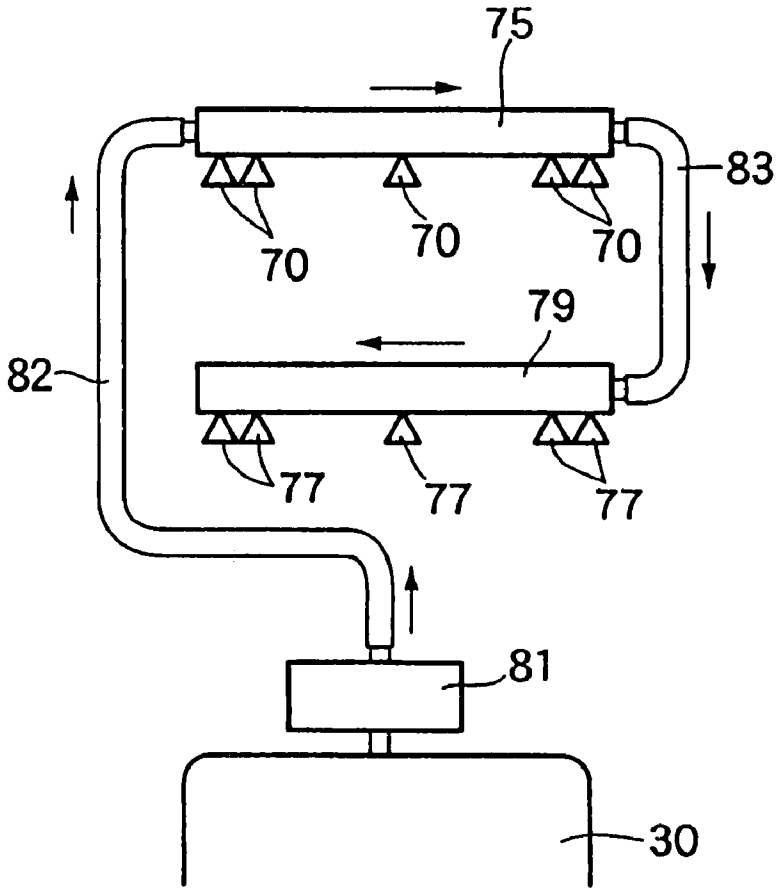
FIG. 7 is a schematic view showing a construction of a fuel piping system.

Referring to FIG. 7, fuel delivered from a fuel pump 81 for pumping fuel up from the fuel tank 30 is supplied to the first delivery pipe 75 via a first fuel hose 82. The fuel is further supplied from the first delivery pipe 75 to the second delivery pipe 79 via a second fuel hose 83. That is, the first delivery pipe 75 and the second delivery pipe 79 are connected in series to the fuel pump 81.

The operation of the preferred embodiment of the present invention will be described. The intake path forming portions 47 . . . form the intake paths 46 . . . having downstream ends in communication with the intake ports 43 . . . disposed in each of the cylinder heads 28F, 28R of the front portion bank BF and the rear portion bank BR included in the engine main body 17. The intake path forming portions 47 . . . are connected to the air chamber 29 such that upstream ends of the intake paths 46 . . . are open to the air chamber 29 commonly provided for the front and rear portion heads 28F, 28R. The first fuel injection valves 70 . . . for high-speed operations for injecting fuel toward upstream end opening portions of the intake paths 46 . . . in the air chamber 29 are disposed in the air chamber 29. The air funnels 50 . . . constituting at least part of the intake path forming portions 47 . . . by forming upstream ends of the intake paths 46 . . . are connected to the first wall portion 29*a* of the air chamber 29. The first fuel injection valves 70 . . . are mounted in the second wall portion 29*b* opposing the first wall portion 29*a* of the air chamber 29 from the outside such that leading end portions thereof face the inside of the air chamber 29.

This allows the volume the first fuel injection valves 70 . . . take up in the air chamber 29 to be made smaller. A substantial volume of the air chamber 29 can therefore be largely secured. An intake noise can be reduced and engine acceleration performance can be enhanced. The degree of freedom in the shape and design of the air chamber 29 can also be increased.

At least part of the air chamber 29 is disposed between the front portion bank BF and the rear portion bank BR. The upstream ends of the intake paths 46 . . . on the side of the front portion bank BF and the rear portion bank BR are disposed close to each other in the air chamber 29 as viewed from a side with the front portion bank BF and the rear portion bank BR arranged in the fore-aft direction. The first fuel injection valves 70 . . . on the side of the front portion bank BF and the rear portion bank BR disposed in the second wall portion 29*b* can therefore be disposed close to each other. This enables a compact disposition of the first fuel injection valves 70 . . . .

In the aforementioned side view with the front portion bank BF and the rear portion bank BR arranged in the fore-aft direction, the center axis of the first fuel injection valves 70 . . . is disposed inside the triangle T formed with the extension lines toward the upstream side of the axes CF, CR of the intake paths 46 on the side of the front and rear portion banks BF, BR and the straight line L connecting the centers on the upstream ends of the intake paths 46 on the side of the front and rear portion banks BF, BR. This allows the first fuel injection valves 70 . . . to be disposed even closer to each other, thus enabling an even more compact disposition of the first fuel injection valves 70 . . . .

The rear portions of the first fuel injection valves 70 . . . are fitted in, and connected to, the first delivery pipe 75 disposed on the outside of the air chamber 29. The coupler portions 70*a* . . . included in the first fuel injection valves 70 . . . , to which electrical wires are connected, are disposed on the outside of the air chamber 29. Thus, the fuel piping and electrical wiring connected to the first fuel injection valves 70 . . . are disposed on the outside of the air chamber 29. This facilitates the jobs of assembling the first fuel injection valves 70 . . . in the air chamber 29 and of servicing and inspecting the first fuel injection valves 70. Thus, this leads to an enhanced workability. Moreover, placement of the fuel piping and the electrical wiring requires no penetration through the wall portion of the air chamber 29. This eliminates the need for extra parts and the like for achieving a good sealing performance.

The second fuel injection valves 77 . . . for injecting fuel at all times during operation of the engine are mounted in the throttle bodies 49 . . . of the intake path forming portions 47 . . . so as to directly inject fuel in the intake paths 46 . . . . This allows fuel to be directly injected in the intake paths 46 . . . from the second fuel injection valves 77 . . . disposed closer to the cylinder heads 28F, 28R. Thus, the response in the fuel supply amount control can therefore be enhanced.

More particularly, the second fuel injection valves 77 . . . are mounted in the throttle bodies 49 . . . downstream from the throttle valves 52 . . . such that the axes thereof run along the planes including the minor axes of the path portions 46*b* . . . at the downstream end of the intake paths 46 . . . inside the throttle bodies 49 . . . . The path portion 46*b* has an elliptical transverse cross section. The second fuel injection valves 77 . . . are therefore brought near to the most ideal center axis of the intake paths 46 . . . , thereby achieving the improved response. Moreover, it is possible to set the distance between the throttle valves 52 . . . and the intake valves 44 . . . to a relatively short value. The second fuel injection valves 77 . . . and the throttle valves 52 . . . can therefore be brought near to the intake valves 44 . . . for achieving the improved response.

The air chamber 29 serves also as the cleaner case for the air cleaner 55 including the filter element 54. This not only eliminates the need for securing a space for disposing of the cleaner case in addition to the air chamber 29, but also reduces the number of parts required.

Further, the air chamber 29 is divided into the purified chamber 62 and the unpurified chamber 63 with the filter element 54 as the partition. The throttle bodies 49 . . . as part of the intake path forming portions 47 . . . are accommodated in the unpurified chamber 63. An even greater volume can be provided for the air chamber 29 as compared with a type, in which the upstream end of the intake path forming portion is connected to the wall portion of the air chamber.

Figure 8:
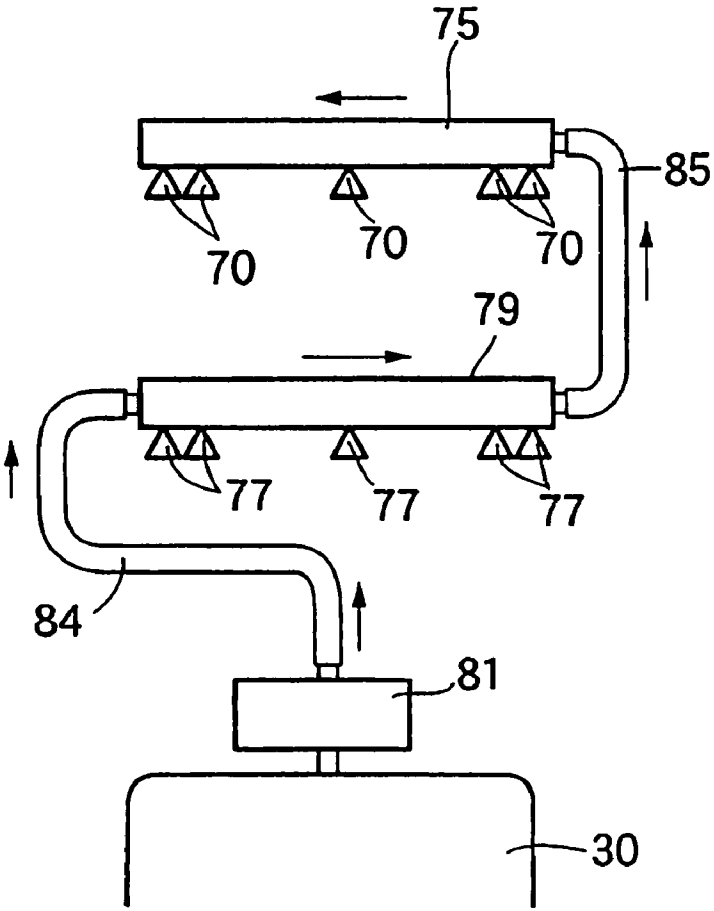
FIG. 8 is a schematic view showing a construction of a fuel piping system according to a first modified example.
Figure 9:
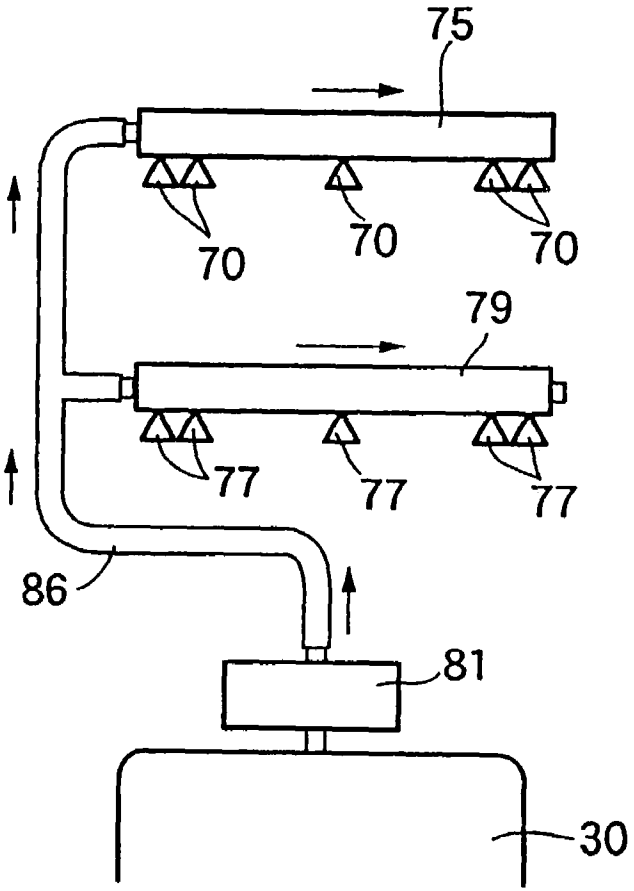
FIG. 9 is a schematic view showing a construction of a fuel piping system according to a second modified example.

It is appropriate that another fuel piping arrangement may be employed as a first modified example of the fuel piping as shown in FIG. 8. More specifically, fuel from a fuel pump 81 is supplied from a fuel hose 84 to a second delivery pipe 79 and further supplied therefrom to a first delivery pipe 75 via a fuel hose 85. It is also appropriate that still another fuel piping arrangement be employed as a second modified example of the fuel piping as shown in FIG. 9. More specifically, fuel from a fuel pump 81 is supplied in parallel from a fuel hose 86 to first and second delivery pipes 75, 79.

The present invention is not limited to the aforementioned embodiments and can be implemented in various manners without departing from the spirit thereof.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intake system for a V-engine, the engine having an engine main body formed into V-shape with first and second banks, comprising:

an intake path forming section forming an intake path having a downstream end in communication with an intake port included in each cylinder head formed in the first and second banks, the intake path forming section connecting to an air chamber common to the cylinder heads such that an upstream end of the intake path opens in the air chamber; and a plurality of fuel injection valves disposed in the air chamber, the valves injecting fuel toward the upstream end opening portion of the intake path in the air chamber;

wherein a path forming member constituting at least part of the intake path forming section by forming the upstream end of the intake path connects to a first wall portion of the air chamber; and wherein each of the plurality of fuel injection valves is mounted from an outside on a second wall portion of the air chamber opposing the first wall portion such that a leading end portion thereof faces an inside of the air chamber.

2. The intake system for a V-engine according to claim 1, wherein at least part of the air chamber is disposed between the first and second banks; and wherein upstream ends of the intake paths on a side of the first and second banks are disposed close to each other as viewed from a side with the first and second banks arranged in a fore-aft direction.

3. The intake system for a V-engine according to claim 2, wherein, in the side view with the first and second banks arranged in the fore-aft direction, a center axis of each of the plurality of fuel injection valves is disposed inside a triangle formed with extension lines towards an upstream side of an axes of the intake paths on the side of the first and second banks with a straight line connecting centers on the upstream ends of the intake paths on the side of the first and second banks.

4. The intake system for a V-engine according to claim 1, wherein each of the plurality of fuel injection valves, a rear portion of which is fitted in, and connected to, a delivery pipe disposed on an outside of the air chamber, is mounted in the second wall portion, by having coupler portions for connecting electrical wires thereto disposed on the outside of the air chamber.

5. The intake system for a V-engine according to claim 2, wherein each of the plurality of fuel injection valves, a rear portion of which is fitted in, and connected to, a delivery pipe disposed on an outside of the air chamber, is mounted in the second wall portion, by having coupler portions for connecting electrical wires thereto disposed on the outside of the air chamber.

6. The intake system for a V-engine according to claim 3, wherein each of the plurality of fuel injection valves, a rear portion of which is fitted in, and connected to, a delivery pipe disposed on an outside of the air chamber, is mounted in the second wall portion, by having coupler portions for connecting electrical wires thereto disposed on the outside of the air chamber.

7. The intake system for a V-engine according to claim 1, wherein each of the plurality of fuel injection valves is disposed in the air chamber as valves for high-speed operation of the engine; and wherein a fuel injection valve for injecting fuel at all times during operation of the engine is mounted in the intake path forming section so as to inject fuel directly into the intake path.

8. The intake system for a V-engine according to claim 2, wherein each of the plurality of fuel injection valves is disposed in the air chamber as valves for high-speed operation of the engine; and wherein a fuel injection valve for injecting fuel at all times during operation of the engine is mounted in the intake path forming section so as to inject fuel directly into the intake path.

9. The intake system for a V-engine according to claim 3, wherein each of the plurality of fuel injection valves is disposed in the air chamber as valves for high-speed operation of the engine; and wherein a fuel injection valve for injecting fuel at all times during operation of the engine is mounted in the intake path forming section so as to inject fuel directly into the intake path.

10. The intake system for a V-engine according to claim 4, wherein each of the plurality of fuel injection valves is disposed in the air chamber as valves for high-speed operation of the engine; and wherein a fuel injection valve for injecting fuel at all times during operation of the engine is mounted in the intake path forming section so as to inject fuel directly into the intake path.

11. The intake system for a V-engine according to claim 1, wherein the air chamber serves also as a cleaner case for an air cleaner including a filter element.

12. The intake system for a V-engine according to claim 2, wherein the air chamber serves also as a cleaner case for an air cleaner including a filter element.

13. The intake system for a V-engine according to claim 3, wherein the air chamber serves also as a cleaner case for an air cleaner including a filter element.

14. The intake system for a V-engine according to claim 4, wherein the air chamber serves also as a cleaner case for an air cleaner including a filter element.

15. The intake system for a V-engine according to claim 11, wherein the air chamber is divided into a purified chamber and an unpurified chamber with the filter element as a partition; and wherein part of the intake path forming section is accommodated inside the unpurified chamber.

16. An intake system for a V-engine, the engine having an engine main body formed into V-shape with first and second banks, comprising:

an intake path having a downstream end in communication with an intake port included in each cylinder head included in the first and second banks, the intake path being connecting to an air chamber common to the cylinder heads such that an upstream end of the intake path opens in the air chamber; and a plurality of fuel injection valves disposed in the air chamber, the valves injecting fuel toward the upstream end opening portion of the intake path in the air chamber;

wherein the intake path forming section forming the upstream end of the intake path connects to a first wall portion of the air chamber; and wherein each of the plurality of fuel injection valves is mounted from an outside on a second wall portion of the air chamber opposing the first wall portion such that a leading end portion thereof faces an inside of the air chamber.

17. The intake system for a V-engine according to claim 16, wherein at least part of the air chamber is disposed between the first and second banks; and wherein upstream ends of the intake paths on a side of the first and second banks are disposed close to each other as viewed from a side with the first and second banks arranged in a fore-aft direction.

18. The intake system for a V-engine according to claim 17, wherein, in the side view with the first and second banks arranged in the fore-aft direction, a center axis of each of the plurality of fuel injection valves is disposed inside a triangle formed with extension lines towards an upstream side of an axes of the intake paths on the side of the first and second banks with a straight line connecting centers on the upstream ends of the intake paths on the side of the first and second banks.

19. The intake system for a V-engine according to claim 16, wherein each of the plurality of fuel injection valves, a rear portion of which is fitted in, and connected to, a delivery pipe disposed on an outside of the air chamber, is mounted in the second wall portion, by having coupler portions for connecting electrical wires thereto disposed on the outside of the air chamber.

20. The intake system for a V-engine according to claim 16, wherein each of the plurality of fuel injection valves is disposed in the air chamber as valves for high-speed operation of the engine; and wherein a fuel injection valve for injecting fuel at all times during operation of the engine is mounted in the intake path forming section so as to inject fuel directly into the intake path.

* * * * *